US008947475B2

(12) United States Patent
Clatanoff et al.

(10) Patent No.: US 8,947,475 B2
(45) Date of Patent: Feb. 3, 2015

(54) SPATIALLY MULTIPLEXED PULSE WIDTH MODULATION

(71) Applicant: Texas Instruments Incorporated, Dallas, TX (US)

(72) Inventors: Todd A. Clatanoff, Allen, TX (US); Philip S. King, Allen, TX (US); Jeffrey M. Kempf, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 317 days.

(21) Appl. No.: 13/660,547

(22) Filed: Oct. 25, 2012

(65) Prior Publication Data

US 2013/0100177 A1 Apr. 25, 2013

Related U.S. Application Data

(60) Provisional application No. 61/604,387, filed on Feb. 28, 2012, provisional application No. 61/551,028, filed on Oct. 25, 2011.

(51) Int. Cl.
*G09G 5/02* (2006.01)
*G09G 5/10* (2006.01)

(52) U.S. Cl.
CPC ..... *G09G 5/10* (2013.01)
USPC ..... 345/693; 345/690; 345/691

(58) Field of Classification Search
CPC . G09G 3/2014; G09G 3/2018; G09G 3/2022; G09G 3/2029; G09G 3/2033; G09G 2320/064
USPC ..... 345/690, 691, 693, 694
See application file for complete search history.

(56) References Cited

U.S. PATENT DOCUMENTS

| | | | | |
|---|---|---|---|---|
| 5,619,228 | A | 4/1997 | Doherty | |
| 7,075,506 | B2 | 7/2006 | Morgan et al. | |
| 7,483,043 | B2 * | 1/2009 | Morgan et al. | 345/690 |
| 7,515,161 | B1 * | 4/2009 | Morgan | 345/691 |
| 7,576,759 | B2 * | 8/2009 | Pettitt et al. | 345/691 |
| 7,804,509 | B2 * | 9/2010 | Thebault et al. | 345/691 |
| 8,111,271 | B2 * | 2/2012 | Hudson et al. | 345/691 |
| 8,174,545 | B2 * | 5/2012 | Morgan | 345/691 |
| 8,199,831 | B2 * | 6/2012 | Correa et al. | 375/240.26 |
| 8,717,394 | B2 * | 5/2014 | Morgan et al. | 345/691 |
| 2002/0005861 | A1 * | 1/2002 | Lewis | 345/691 |
| 2003/0231194 | A1 * | 12/2003 | Morgan et al. | 345/691 |
| 2005/0052703 | A1 * | 3/2005 | Pettitt et al. | 358/3.19 |
| 2006/0197776 | A1 * | 9/2006 | Morgan et al. | 345/598 |
| 2007/0064019 | A1 * | 3/2007 | Thebault et al. | 345/691 |
| 2007/0076019 | A1 * | 4/2007 | Randall | 345/691 |
| 2007/0252856 | A1 * | 11/2007 | Hudson et al. | 345/693 |

(Continued)

*Primary Examiner* — Gene W Lee

(74) *Attorney, Agent, or Firm* — Jacqueline J. Garner; Frederick J. Telecky, Jr.

(57) ABSTRACT

A process of operating a PWM display system wherein some display data bits are assigned substantially equal time weights. Display data codewords are defined for every pixel intensity value to form display data codeword tables so that there are at least as many display data codeword tables as the number of display data bits with substantially equal time weights. The display pixel is subsequently operated in a digital manner according to the display data codeword in the selected display data codeword table to display a desired pixel intensity value. The display data codeword tables are configured so that immediately adjacent display pixels are operated so that identical pixel intensity values are displayed with different temporal sequences.

17 Claims, 10 Drawing Sheets

EXAMPLE OF A PIXEL STATUS TIME CHART FOR A CHOSEN PIXEL INTENSITY VALUE

900

| DISPLAY DATA BITS FOR PIXEL INTENSITY VALUE = 139.5 | | | | | | | | |
|---|---|---|---|---|---|---|---|---|
| DISPLAY DATA CODEWORD TABLE INDEX | BIT 7 | BIT 6 | BIT 5 | BIT 4 | BIT 3 | BIT 2 | BIT 1 | BIT 0 |
| 0 | 0 | 1 | 0 | 1 | 1 | 1 | 1 | 0 |
| 1 | 1 | 0 | 1 | 0 | 1 | 1 | 0 | 0 |

(56) References Cited

U.S. PATENT DOCUMENTS

2008/0007576 A1* 1/2008 Ishii et al. ..... 345/691
2009/0021540 A1* 1/2009 Morgan et al. ..... 345/691
2009/0225071 A1* 9/2009 Arai et al. ..... 345/214
2010/0053200 A1* 3/2010 Correa et al. ..... 345/600
2010/0091040 A1* 4/2010 Morgan ..... 345/690
2012/0218323 A1 8/2012 Morgan

* cited by examiner

206

EXAMPLE OF A HIGH SPATIAL FREQUENCY THRESHOLD ARRAY EXAMPLE

| | COL 1 | COL 2 | COL 3 | COL 4 | COL 5 | COL 6 | COL 7 | COL 8 | COL 9 | COL 10 | COL 11 | COL 12 | COL 13 | COL 14 | COL 15 |
|---|---|---|---|---|---|---|---|---|---|---|---|---|---|---|---|
| ROW 1 | 769 | 174 | 945 | 140 | 791 | 78 | 225 | 666 | 276 | 728 | 148 | 952 | 230 | 788 | 51 |
| ROW 2 | 359 | 842 | 262 | 659 | 345 | 1004 | 568 | 366 | 931 | 425 | 835 | 311 | 686 | 409 | 978 |
| ROW 3 | 612 | 28 | 510 | 895 | 116 | 442 | 861 | 2 | 767 | 111 | 587 | 31 | 879 | 196 | 642 |
| ROW 4 | 954 | 426 | 757 | 286 | 594 | 718 | 184 | 506 | 622 | 227 | 997 | 477 | 544 | 86 | 766 |
| ROW 5 | 91 | 677 | 177 | 989 | 42 | 826 | 340 | 962 | 294 | 796 | 388 | 729 | 266 | 923 | 365 |
| ROW 6 | 817 | 337 | 866 | 378 | 532 | 221 | 665 | 82 | 875 | 126 | 645 | 168 | 809 | 433 | 670 |
| ROW 7 | 471 | 570 | 69 | 654 | 468 | 938 | 397 | 738 | 446 | 558 | 348 | 950 | 54 | 591 | 239 |
| ROW 8 | 906 | 269 | 972 | 153 | 808 | 121 | 609 | 253 | 1017 | 34 | 843 | 509 | 323 | 882 | 124 |
| ROW 9 | 206 | 778 | 405 | 707 | 320 | 885 | 13 | 514 | 783 | 214 | 678 | 149 | 760 | 447 | 994 |
| ROW 10 | 508 | 40 | 615 | 524 | 198 | 755 | 370 | 919 | 312 | 582 | 418 | 967 | 283 | 644 | 200 |
| ROW 11 | 815 | 293 | 928 | 90 | 999 | 448 | 649 | 155 | 709 | 76 | 900 | 112 | 554 | 23 | 814 |
| ROW 12 | 189 | 715 | 379 | 830 | 237 | 585 | 60 | 949 | 469 | 822 | 238 | 746 | 480 | 872 | 364 |
| ROW 13 | 465 | 623 | 162 | 488 | 739 | 300 | 851 | 194 | 538 | 383 | 658 | 336 | 982 | 224 | 626 |
| ROW 14 | 915 | 49 | 988 | 553 | 24 | 965 | 422 | 768 | 284 | 1003 | 137 | 586 | 66 | 726 | 428 |
| ROW 15 | 525 | 362 | 787 | 247 | 676 | 342 | 617 | 100 | 700 | 17 | 880 | 443 | 833 | 160 | 531 |
| ROW 16 | 210 | 704 | 115 | 894 | 461 | 837 | 151 | 916 | 484 | 563 | 218 | 669 | 275 | 951 | 3 |
| ROW 17 | 960 | 434 | 624 | 326 | 75 | 526 | 257 | 802 | 315 | 937 | 386 | 781 | 505 | 352 | 696 |
| ROW 18 | 1 | 804 | 143 | 933 | 710 | 1019 | 394 | 600 | 81 | 745 | 169 | 50 | 1008 | 598 | 197 |
| ROW 19 | 737 | 307 | 502 | 580 | 233 | 20 | 772 | 205 | 980 | 453 | 628 | 876 | 251 | 96 | 753 |
| ROW 20 | 981 | 193 | 871 | 360 | 828 | 436 | 650 | 521 | 130 | 701 | 292 | 547 | 432 | 838 | 487 |
| ROW 21 | 437 | 618 | 45 | 695 | 164 | 953 | 301 | 891 | 363 | 852 | 26 | 959 | 338 | 655 | 166 |
| ROW 22 | 908 | 268 | 1001 | 470 | 557 | 103 | 790 | 58 | 575 | 241 | 759 | 145 | 798 | 70 | 979 |
| ROW 23 | 523 | 131 | 779 | 324 | 748 | 256 | 630 | 420 | 1010 | 474 | 623 | 400 | 518 | 716 | 236 |
| ROW 24 | 825 | 413 | 634 | 71 | 901 | 385 | 941 | 180 | 714 | 83 | 898 | 202 | 932 | 302 | 862 |
| ROW 25 | 922 | 235 | 970 | 175 | 500 | 675 | 14 | 540 | 331 | 812 | 278 | 692 | 4 | 589 | 104 |
| ROW 26 | 475 | 730 | 374 | 576 | 782 | 211 | 836 | 460 | 976 | 107 | 567 | 483 | 991 | 350 | 824 |
| ROW 27 | 652 | 134 | 854 | 44 | 309 | 926 | 347 | 653 | 250 | 744 | 384 | 877 | 171 | 771 | 507 |
| ROW 28 | 535 | 260 | 993 | 493 | 721 | 152 | 593 | 35 | 890 | 183 | 631 | 67 | 313 | 660 | 33 |
| ROW 29 | 929 | 414 | 602 | 117 | 829 | 441 | 1022 | 403 | 780 | 520 | 940 | 438 | 850 | 550 | 263 |
| ROW 30 | 61 | 794 | 334 | 687 | 240 | 551 | 92 | 702 | 339 | 123 | 280 | 680 | 207 | 1013 | 458 |
| ROW 31 | 705 | 216 | 899 | 18 | 961 | 303 | 845 | 195 | 611 | 986 | 820 | 16 | 764 | 113 | 335 |
| ROW 32 | 395 | 562 | 467 | 616 | 407 | 735 | 497 | 909 | 57 | 462 | 537 | 372 | 614 | 498 | 912 |

TO FIG. 2B

204

FIG. 2A

202

106

FROM FIG. 2A

EXAMPLE OF A HIGH SPATIAL FREQUENCY THRESHOLD ARRAY EXAMPLE

206

| COL 16 | COL 17 | COL 18 | COL 19 | COL 20 | COL 21 | COL 22 | COL 23 | COL 24 | COL 25 | COL 26 | COL 27 | COL 28 | COL 29 | COL 30 | COL 31 | COL 32 |
|---|---|---|---|---|---|---|---|---|---|---|---|---|---|---|---|---|
| 559 | 708 | 424 | 530 | 127 | 683 | 375 | 883 | 95 | 706 | 351 | 606 | 299 | 671 | 12 | 533 | 1015 |
| 318 | 244 | 943 | 212 | 856 | 1020 | 264 | 511 | 629 | 219 | 870 | 73 | 839 | 393 | 786 | 279 | 135 |
| 494 | 840 | 97 | 648 | 330 | 74 | 789 | 165 | 948 | 402 | 541 | 463 | 727 | 170 | 935 | 485 | 717 |
| 138 | 608 | 411 | 770 | 490 | 583 | 427 | 719 | 0 | 813 | 281 | 1009 | 232 | 572 | 56 | 853 | 243 |
| 1011 | 297 | 904 | 36 | 966 | 139 | 848 | 322 | 599 | 192 | 694 | 38 | 887 | 353 | 662 | 410 | 534 |
| 8 | 560 | 187 | 712 | 369 | 664 | 248 | 990 | 476 | 905 | 377 | 625 | 495 | 765 | 144 | 992 | 191 |
| 847 | 466 | 797 | 273 | 519 | 896 | 48 | 546 | 85 | 777 | 159 | 955 | 259 | 98 | 868 | 298 | 733 |
| 723 | 329 | 944 | 106 | 607 | 201 | 763 | 341 | 681 | 287 | 584 | 419 | 834 | 539 | 444 | 610 | 6 |
| 527 | 62 | 636 | 440 | 1007 | 389 | 841 | 452 | 969 | 120 | 805 | 21 | 684 | 222 | 920 | 356 | 672 |
| 406 | 917 | 173 | 756 | 25 | 691 | 146 | 569 | 226 | 884 | 512 | 367 | 987 | 65 | 751 | 122 | 1021 |
| 697 | 271 | 832 | 349 | 545 | 306 | 927 | 77 | 638 | 319 | 734 | 178 | 621 | 482 | 314 | 574 | 417 |
| 87 | 566 | 478 | 974 | 229 | 873 | 489 | 793 | 415 | 998 | 99 | 857 | 258 | 799 | 939 | 242 | 874 |
| 910 | 132 | 711 | 39 | 656 | 161 | 731 | 7 | 254 | 685 | 450 | 555 | 390 | 699 | 27 | 651 | 102 |
| 288 | 1023 | 382 | 801 | 429 | 581 | 371 | 942 | 597 | 167 | 907 | 72 | 971 | 147 | 504 | 355 | 762 |
| 775 | 188 | 613 | 255 | 958 | 89 | 849 | 291 | 499 | 811 | 332 | 742 | 215 | 601 | 816 | 1005 | 274 |
| 860 | 496 | 53 | 889 | 522 | 217 | 698 | 128 | 1014 | 41 | 643 | 464 | 863 | 304 | 421 | 80 | 592 |
| 399 | 657 | 310 | 736 | 346 | 784 | 455 | 573 | 396 | 754 | 234 | 542 | 22 | 947 | 722 | 181 | 858 |
| 925 | 114 | 995 | 150 | 595 | 63 | 914 | 182 | 867 | 108 | 983 | 357 | 673 | 129 | 486 | 641 | 381 |
| 282 | 556 | 459 | 821 | 416 | 973 | 265 | 688 | 328 | 605 | 439 | 892 | 249 | 774 | 924 | 285 | 528 |
| 888 | 30 | 713 | 204 | 663 | 9 | 548 | 479 | 819 | 68 | 724 | 154 | 565 | 404 | 55 | 846 | 110 |
| 620 | 343 | 946 | 290 | 869 | 373 | 761 | 125 | 934 | 228 | 515 | 827 | 321 | 1012 | 603 | 223 | 674 |
| 401 | 785 | 141 | 501 | 590 | 186 | 1002 | 305 | 647 | 392 | 977 | 11 | 668 | 136 | 492 | 810 | 354 |
| 552 | 43 | 646 | 897 | 88 | 703 | 451 | 792 | 46 | 579 | 261 | 752 | 430 | 921 | 295 | 741 | 29 |
| 457 | 1018 | 267 | 380 | 800 | 252 | 543 | 163 | 903 | 473 | 855 | 172 | 536 | 84 | 864 | 209 | 578 |
| 679 | 199 | 740 | 491 | 963 | 19 | 930 | 344 | 732 | 105 | 661 | 361 | 957 | 637 | 398 | 690 | 109 |
| 391 | 918 | 59 | 571 | 296 | 667 | 408 | 627 | 220 | 1016 | 289 | 803 | 32 | 270 | 503 | 1006 | 316 |
| 156 | 619 | 333 | 776 | 190 | 831 | 118 | 878 | 513 | 64 | 596 | 454 | 725 | 911 | 185 | 806 | 5 |
| 956 | 431 | 881 | 93 | 1000 | 445 | 564 | 246 | 773 | 412 | 893 | 203 | 529 | 101 | 604 | 358 | 747 |
| 743 | 231 | 689 | 517 | 368 | 720 | 52 | 968 | 325 | 693 | 133 | 984 | 308 | 865 | 435 | 964 | 158 |
| 859 | 79 | 577 | 142 | 807 | 208 | 640 | 472 | 844 | 15 | 633 | 376 | 750 | 47 | 682 | 245 | 516 |
| 639 | 387 | 985 | 277 | 902 | 317 | 936 | 179 | 549 | 272 | 795 | 481 | 561 | 213 | 823 | 327 | 886 |
| 176 | 818 | 10 | 749 | 456 | 588 | 37 | 758 | 423 | 996 | 157 | 913 | 119 | 975 | 449 | 635 | 94 |

106 202

FIG. 2B

EXAMPLES OF ASSIGNMENTS OF A DISPLAY DATA CODEWORD TABLE INDEX TO A PIXEL

TABLE 4A

| TWO DISPLAY DATA CODEWORD TABLES | |
|---|---|
| THRESHOLD VALUE | CODEWORD TABLE INDEX |
| 0% TO 25% | 0 |
| >25% TO 50% | 1 |
| >50% TO 75% | 0 |
| >75% TO 100% | 1 |

TABLE 4B

| THREE DISPLAY DATA CODEWORD TABLES | |
|---|---|
| THRESHOLD VALUE | CODEWORD TABLE INDEX |
| 0% TO 17% | 0 |
| >17% TO 33% | 1 |
| >33% TO 50% | 2 |
| >50% TO 67% | 0 |
| >67% TO 83% | 1 |
| >83% TO 100% | 2 |

TABLE 4C

| FOUR DISPLAY DATA CODEWORD TABLES EXAMPLE 1 | |
|---|---|
| THRESHOLD VALUE | CODEWORD TABLE INDEX |
| 0% TO 12% | 0 |
| >12% TO 25% | 1 |
| >25% TO 37% | 2 |
| >37% TO 50% | 3 |
| >50% TO 62% | 0 |
| >62% TO 75% | 1 |
| >75% TO 87% | 2 |
| >87% TO 100% | 3 |

TABLE 4D

| FOUR DISPLAY DATA CODEWORD TABLES EXAMPLE 2 | |
|---|---|
| THRESHOLD VALUE | CODEWORD TABLE INDEX |
| 0% TO 12% | 0 |
| >12% TO 25% | 1 |
| >25% TO 37% | 2 |
| >37% TO 50% | 3 |
| >50% TO 62% | 0 |
| >62% TO 75% | 2 |
| >75% TO 87% | 1 |
| >87% TO 100% | 3 |

FIG. 4

| EXAMPLE OF A GENERAL CASE OF ASSIGNMENTS OF A DISPLAY DATA CODEWORD TABLE INDEX TO A PIXEL | |
|---|---|
| N DISPLAY DATA CODEWORD TABLES | |
| THRESHOLD VALUE | CODEWORD TABLE INDEX |
| 0 TO 1/2N | 0 |
| >1/2N TO 2/2N | 1 |
| >2/2N TO 3/2N | 2 |
| ⋮ | |
| >(N-2)/2N TO (N-1)/2N | N-2 |
| >(N-1)/2N TO N/2N | N-1 |
| >N/2N TO (N+1)/2N | 0 |
| >(N+1)/2N TO (N+2)/2N | 1 |
| >(N+2)/2N TO (N+3)/2N | 2 |
| ⋮ | |
| >(2N-2)/2N TO (2N-1)/2N | N-2 |
| >(2N-1)/2N TO 100% | N-1 |

FIG. 5

| EXAMPLE OF A GENERAL CASE OF ASSIGNMENTS OF A DISPLAY DATA CODEWORD TABLE INDEX TO A PIXEL USING A LOOK-UP TABLE | |
|---|---|
| N DISPLAY DATA CODEWORD TABLES | |
| THRESHOLD VALUE | CODEWORD TABLE INDEX |
| 1 | 0 |
| 2 | 1 |
| 3 | 2 |
| 4 | 0 |
| 5 | 2 |
| 6 | 1 |
| ⋮ | |
| 1021 | 2 |
| 1022 | 1 |
| 1023 | 0 |
| 1024 | 1 |

FIG. 6

EXAMPLES OF BIT TIME GROUP ASSIGNMENTS

TABLE 7A

SIX DISPLAY DATA BITS
TWO DISPLAY DATA BITS
PER TIME GROUP
ALL DISPLAY DATA BITS
ASSIGNED TO TIME GROUPS

| DISPLAY DATA BIT | TIME WEIGHT | TIME GROUP |
|---|---|---|
| 0 | 11 | A |
| 1 | 11 | |
| 2 | 33 | B |
| 3 | 33 | |
| 4 | 83.5 | C |
| 5 | 83.5 | |

TABLE 7B

SEVEN DISPLAY DATA BITS
THREE DISPLAY DATA BITS
PER TIME GROUP
NOT ALL DISPLAY DATA BITS
ASSIGNED TO TIME GROUPS

| DISPLAY DATA BIT | TIME WEIGHT | TIME GROUP |
|---|---|---|
| 0 | 10 | N/A |
| 1 | 20 | A |
| 2 | 20 | |
| 3 | 20 | |
| 4 | 61.67 | B |
| 5 | 61.67 | |
| 6 | 61.67 | |

TABLE 7C

TEN DISPLAY DATA BITS
TWO OR THREE DISPLAY
DATA BITS PER TIME GROUP
ALL DISPLAY DATA BITS
ASSIGNED TO TIME GROUPS

| DISPLAY DATA BIT | TIME WEIGHT | TIME GROUP |
|---|---|---|
| 0 | 5 | A |
| 1 | 5 | |
| 2 | 15 | B |
| 3 | 15 | |
| 4 | 30 | C |
| 5 | 30 | |
| 6 | 30 | |
| 7 | 41.67 | D |
| 8 | 41.67 | |
| 9 | 41.67 | |

TABLE 7D

EIGHT DISPLAY DATA BITS
TWO DISPLAY DATA BITS
PER TIME GROUP
ALL DISPLAY DATA BITS
ASSIGNED TO TIME GROUPS

| DISPLAY DATA BIT | TIME WEIGHT | TIME GROUP |
|---|---|---|
| 0 | 4 | A |
| 1 | 4 | |
| 2 | 12 | B |
| 3 | 12 | |
| 4 | 32 | C |
| 5 | 32 | |
| 6 | 79.5 | D |
| 7 | 79.5 | |

FIG. 7A

EXAMPLES OF BIT TIME GROUP ASSIGNMENTS

TABLE 7E

FOURTEEN DISPLAY DATA BITS
TWO DISPLAY DATA BITS
PER TIME GROUP
ALL DISPLAY DATA BITS
ASSIGNED TO TIME GROUPS

| DISPLAY DATA BIT | TIME WEIGHT | TIME GROUP |
|---|---|---|
| 0 | 1 | A |
| 1 | 1 | |
| 2 | 2 | B |
| 3 | 2 | |
| 4 | 4 | C |
| 5 | 4 | |
| 6 | 8 | D |
| 7 | 8 | |
| 8 | 16 | E |
| 9 | 16 | |
| 10 | 32 | F |
| 11 | 32 | |
| 12 | 64.5 | G |
| 13 | 64.5 | |

TABLE 7F

FIFTEEN DISPLAY DATA BITS
TWO DISPLAY DATA BITS
PER TIME GROUP
NOT ALL DISPLAY DATA BITS
ASSIGNED TO TIME GROUPS

| DISPLAY DATA BIT | TIME WEIGHT | TIME GROUP |
|---|---|---|
| 0 | 0.5 | N/A |
| 1 | 1 | A |
| 2 | 1 | |
| 3 | 2 | B |
| 4 | 2 | |
| 5 | 4 | C |
| 6 | 4 | |
| 7 | 8 | D |
| 8 | 8 | |
| 9 | 16 | E |
| 10 | 16 | |
| 11 | 32 | F |
| 12 | 32 | |
| 13 | 64.25 | G |
| 14 | 64.25 | |

TABLE 7G

SIXTEEN DISPLAY DATA BITS
TWO DISPLAY DATA BITS
PER TIME GROUP
ALL DISPLAY DATA BITS
ASSIGNED TO TIME GROUPS

| DISPLAY DATA BIT | TIME WEIGHT | TIME GROUP |
|---|---|---|
| 0 | .5 | A |
| 1 | .5 | |
| 2 | 1 | B |
| 3 | 1 | |
| 4 | 2 | C |
| 5 | 2 | |
| 6 | 4 | D |
| 7 | 4 | |
| 8 | 8 | E |
| 9 | 8 | |
| 10 | 16 | F |
| 11 | 16 | |
| 12 | 32 | G |
| 13 | 32 | |
| 14 | 64 | H |
| 15 | 64 | |

TABLE 7H

SIXTEEN DISPLAY DATA BITS
FOUR DISPLAY DATA BITS
PER TIME GROUP
ALL DISPLAY DATA BITS
ASSIGNED TO TIME GROUPS

| DISPLAY DATA BIT | TIME WEIGHT | TIME GROUP |
|---|---|---|
| 0 | 2 | A |
| 1 | 2 | |
| 2 | 2 | |
| 3 | 2 | |
| 4 | 8 | B |
| 5 | 8 | |
| 6 | 8 | |
| 7 | 8 | |
| 8 | 20 | C |
| 9 | 20 | |
| 10 | 20 | |
| 11 | 20 | |
| 12 | 33.75 | D |
| 13 | 33.75 | |
| 14 | 33.75 | |
| 15 | 33.75 | |

FIG. 7B

SPATIALLY MULTIPLEXED PULSE WIDTH MODULATION

This application claims the benefit of Provisional Application No. 61/551,028, filed Oct. 25, 2011, and of Provisional Application No. 61/604,387, filed Feb. 28, 2012, the entireties of both of which are hereby incorporated by reference.

This relates to display systems and, more particularly, to digital display systems using pulse width modulation.

BACKGROUND

Digital display systems typically produce or modulate light as a linear function of input image data for each pixel. For an 8-bit monochromatic image data word, the input image data word ranges from 0 to 255. A value of 0 results in no light being transmitted to or produced by a pixel, 255 is the maximum intensity level for a pixel, and 128 is mid-scale light.

Pulse width modulation (PWM) schemes typically modulate a constant intensity light source in time periods whose length depends on time weighting of display bits. For example, when 5500 microseconds is available for each color of a three-color system the pixel on times for a system using 9 display data bits might be 14 microseconds, 28 microseconds, 56 microseconds, 112 microseconds, 224 microseconds, 448 microseconds, 896 microseconds, 1861 microseconds, and 1861 microseconds, respectively. If a given display data bit for a particular pixel is a logic 0, no light is emitted from or generated by the pixel. If the display data bit is a logic 1, then the maximum amount of light is emitted from or generated by the pixel during the display data bit period. The viewer's eye integrates the light received by a particular pixel during an entire frame period to produce the perception of an intermediate intensity level.

One problem encountered by PWM display systems is the creation of visual artifacts that arise due to the generation of an image as a series of discrete bursts of light. While stationary viewers perceive stationary objects as having the correct intensity, motion of the viewer's eye or motion in the image can create an artifact of false contours produced by saccadic eye movement, known as PWM temporal contouring. PWM temporal artifacts are described in U.S. Pat. No. 5,619,228. PWM temporal artifacts are created when the distribution of radiant energy is not constant over an entire frame period and may be noticeable when there is motion in a scene or when the eye moves across a scene.

When the eye moves across a scene, a given point on the retina of the eye accumulates light from more than one image pixel during the eye's integration period. If the various pixels are all displaying the same intensity in the same way—the discrete bursts of light are occurring simultaneously for all pixels—the perceived pixel intensity will be correct. If the various pixels are not displaying the same intensity in the same way the eye may register false perceived intensities which may appear brighter or darker than the average displayed intensity. This happens when the discrete bright periods of a first pixel are created during a first portion of the frame period and the eye then scans to a second pixel that uses the next portion of the frame period to display the light. Since the same point on the retina receives the light from the first pixel and the second pixel in rapid succession—less than the decay period of the eye—that point of the retina perceives a single pixel as bright or as dark as the sum of the first and second pixels. This PWM temporal contouring artifact appears as a noticeable pulsation in the image pixels. This pulsation is time-varying and creates apparent contours in an image that do not exist in the input image data.

When viewed at a normal viewing distance, the PWM contouring artifact created by two adjacent pixels is very difficult, if not impossible, for the typical viewer to detect. In real images, however, the bit transitions often occur in areas having a large number of adjacent pixels with virtually identical image data values. If these large areas of similar pixels have clusters whose intensity values cross a major bit transition, the PWM contouring is much easier to detect.

Given the quantization and temporal artifacts created by PWM displays, a process and system of producing very small intensity changes and eliminating noticeable temporal artifacts is needed.

Related subject matter may also be found in U.S. Pat. No. 7,075,506, the entirety of which are incorporated herein by reference.

SUMMARY

A process and system for operating a PWM display is provided which groups display data bits into one or more time groups with substantially equal time weights for display data bits in each time group. A display data codeword is a set of values for the display data bits for a given pixel intensity value. Display data codewords are defined for every pixel intensity value to form display data codeword tables so that the number of display data codeword tables is at least as many as the number of display data bits in the time group containing the most display data bits. The display data codeword tables may be configured as look-up tables (LUTs). A high spatial frequency threshold array is mapped onto the pixel array of the PWM display; the threshold array provides a threshold value for each pixel. The threshold value for a display pixel is used to select an index corresponding to one of the display data codeword tables. The display pixel is subsequently operated in a digital manner according to the display data codeword in the selected display data codeword table to display a desired pixel intensity value. The threshold array and display data codeword tables are configured so that immediately adjacent display pixels are operated so that identical pixel intensity values are displayed with different temporal sequences, so as to reduce PWM temporal contouring artifacts.

BRIEF DESCRIPTION OF THE DRAWINGS

FIGS. 2A and 2B illustrate an example of a high spatial frequency threshold array.

FIG. 4 illustrates examples of assignments of a display data codeword table index to a pixel.

FIG. 5 illustrates an example of a general case of assignments of a display data codeword table index to a pixel.

FIG. 6 illustrates an example of a general case of assignments of a display data codeword table index to a pixel using a look-up table.

FIGS. 7A and 7B illustrate examples of bit time group assignments.

DETAILED DESCRIPTION OF EXAMPLE EMBODIMENTS

Examples of PWM displays are plasma television sets, Liquid Crystal On Silicon (LCOS) displays and Digital Micromirror Device (DMDs) displays operated in a digitally addressable manner. Each pixel in a PWM display has a row number and a column number, together which uniquely identify the pixel. The term "immediately adjacent pixel" is understood to refer to a pixel which laterally or diagonally abuts the pixel of interest.

Pixel display intensity may be represented by a number, bounded by a minimum intensity value and a maximum intensity value, which corresponds to a brightness level to be displayed by the pixel. The pixel display intensity provided to a PWM display may have been previously manipulated by software and/or hardware. A display data codeword may be used to define the digital states of the display data bits and has a corresponding display intensity. Each display data codeword defines the digital states of the pixel in a temporal sequence of display data bits, which is used to achieve the corresponding pixel display intensity. A collection of display data codewords is used to represent range of display intensities from no light to the maximum intensity.

A process and system for operating a PWM display is provided which groups display data bits into one or more time groups with substantially equal time weights for display data bits in each time group. Sets of display data codewords are defined for every pixel intensity value to form display data codeword tables so that the number of display data codeword tables is at least as many as the number of bits in the time group containing the most bits. The display data codeword tables may be configured as look-up tables (LUTs). A high spatial frequency threshold array is mapped onto the pixel array of the PWM display; the threshold array provides a threshold value for each pixel. The threshold value for a display pixel is used to select an index corresponding to one of the display data codeword tables. A display data codeword is selected from the display data codeword table corresponding to a desired pixel intensity value. The display pixel is subsequently operated in a digital manner according to the display data codeword in the selected display data codeword table. The threshold array and display data codeword tables are configured so that immediately adjacent display pixels are operated so that identical pixel intensity values are displayed with different temporal sequences, so as to reduce PWM temporal contouring artifacts. It will be recognized that the process and system for operating a PWM display described herein may be applied to one or more color channels of a multi-color PWM display system.

Figure 1:
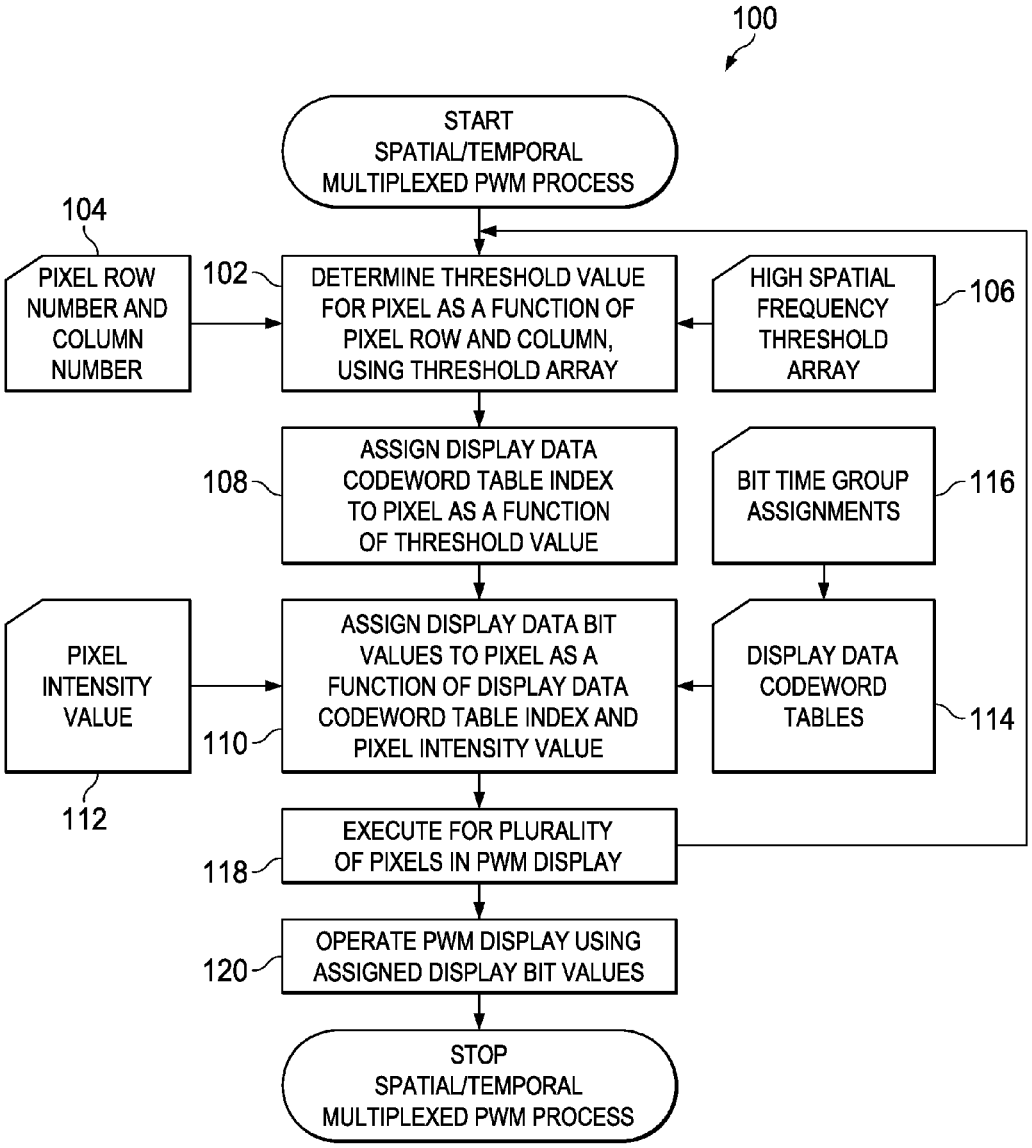
FIG. 1 is a flowchart of a process and system for operating a PWM display using a spatial/temporal multiplexed PWM process.

FIG. 1 is a flowchart of a process and system for operating a PWM display using a spatial/temporal multiplexed PWM process. The process 100 begins with step 102 which is to determine threshold value for a pixel as function of a pixel row and column, using a threshold array. In this step, the pixel row number and column number 104 are used to identify an element of a high spatial frequency threshold array 106. An example of a high spatial frequency threshold array is discussed in reference to FIGS. 2A and 2B below. Details of step 102 are discussed in reference to FIG. 3 below. In a subsequent iteration of the process and system for operating a PWM display 100, a different threshold array 106 may be used, as taught by U.S. Pat. No. 7,075,506.

Subsequent to step 102, step 108 is to assign a display data codeword table index to the pixel as function of the threshold value determined in step 102. The threshold array 106 is configured so that some immediately adjacent pixels are assigned different display data codeword table indices. The display data codeword table index may be, for example, a stored logical value, or may be an electrical signal. Details of step 1008 are discussed in reference to FIGS. 4-6, below.

Subsequent to step 108, step 110 is to assign a display data codeword to the pixel as a function of the display data codeword table index, which was assigned in step 108, and a pixel intensity value 112. The pixel intensity value 112 is provided according to a pattern to be displayed on the PWM display. The display data codeword is chosen to provide a displayed intensity from the pixel which corresponds to the pixel intensity value 112. The display data codeword is chosen from one of a set of display data codeword tables 114; the selected display data codeword table 114 corresponds to the display data codeword table index which was assigned in step 108. The display data codeword tables 114 are configured so that display data codeword in each display data codeword table 114 which correspond to a given pixel intensity value 112 may have different values for bits with substantially equal time weights. Examples of display data codeword tables will be discussed in reference to Tables 1 and 2, below.

Steps 102 through 110 are executed for a plurality, possibly all, of the pixels in the PWM display. After the display data codewords have been assigned to a desired set of pixels, step 120 is executed which is to operate the pixel using the display data codeword which was assigned in step 110.

FIGS. 2A and 2B illustrate an example of a high spatial frequency threshold array, which is element 106 of FIG. 1. The threshold array 106 of the instant embodiment has 32 rows and 32 columns. Threshold values 202 in the threshold array 106 include integers from 1 to 124, and include exactly one instance of each integer. In other versions of the instant embodiment, a different set of threshold values 202 may be included in the threshold array 106, possibly including two or more instances of a threshold value. The threshold values 202 have a spatial configuration which exhibits higher amplitudes for higher spatial frequencies than for lower spatial frequencies, as taught by U.S. Pat. No. 7,075,506. Each threshold value 202 is uniquely specified by a threshold array row number 204 and a threshold array column number 206.

Figure 3:
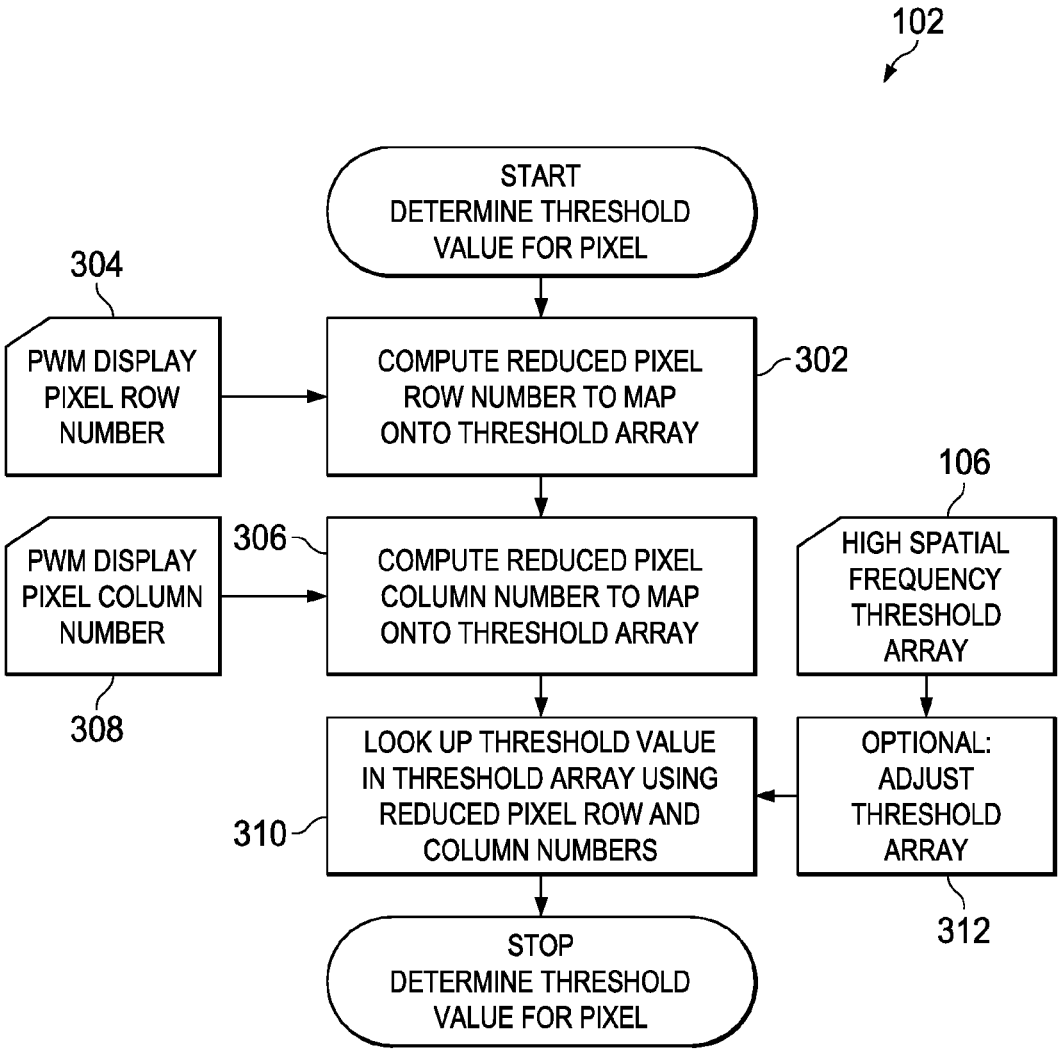
FIG. 3 is a flowchart of the process to determine threshold value for a pixel as function of a pixel row and column, using a threshold array.

FIG. 3 is a flowchart of the process to determine threshold value for a pixel as function of a pixel row and column, using a threshold array, which is step 102 in FIG. 1. The process 102 begins with step 302 which is to compute a reduced pixel row number to map onto the threshold array, using the PWM display pixel row number 304. In one version of the instant embodiment, the reduced pixel row number may be computed as a remainder of dividing the PWM display pixel row number 304 by the number of rows in the threshold array 106. Using the example threshold array 106 of FIGS. 2A and 2B, a PWM display pixel row number of 37 would map to a reduced pixel row number of 5. Other versions of the instant embodiment may have other processes to compute the reduced pixel row number, so that vertically adjacent PWM display pixels map to vertically adjacent threshold array values 202.

Step 306 is to compute a reduced pixel column number to map onto the threshold array, using the PWM display pixel column number 308. In one version of the instant embodiment, the reduced pixel column number may be computed as a remainder of dividing the PWM display pixel column number 308 by the number of columns in the threshold array 106. Using the example threshold array 106 of FIGS. 2A and 2B, a PWM display pixel column number of 42 would map to a reduced pixel column number of 10. Other versions of the instant embodiment may have other processes to compute the reduced pixel column number, so that laterally adjacent PWM display pixels map to laterally adjacent threshold array values 202.

Using the example processes for computing reduced pixel row and column numbers, a vertically immediately adjacent PWM display pixel with a PWM display pixel row number of 38 and a PWM display pixel column number of 42 would have a reduced pixel row number of 6 and a reduced pixel column number of 10. Steps 302 and 306 may be performed in any order, or concurrently.

Subsequent to computing the reduced pixel row and column numbers in steps 302 and 306, step 310 is to look up a threshold value in the threshold array 106 using the reduced pixel row and column numbers. The threshold array 106 may possibly be adjusted in optional step 312 prior to looking up the threshold value. For example, in step 312 the threshold array may be rotated, reflected or spatially inverted, and/or values in the threshold array may be uniformly incremented or decremented, or bit-wise inverted. The reduced pixel row number maps to the threshold array row number 204 of FIGS. 2A and 2B, and the reduced pixel column number maps to the threshold array column number 206 of FIGS. 2A and 2B. Using the example pixel with reduced row number, 5, and reduced column number, 10, described above, the threshold array 106 of FIGS. 2A and 2B provides a threshold value of 796. Similarly, the example vertically immediately adjacent pixel with reduced row number, 6, and reduced column number, 10, described above, the threshold array 106 of FIGS. 2A and 2B provides a threshold value of 126.

FIG. 4 illustrates examples in Tables 4A-4D of assignments of a display data codeword table index to a pixel. Each display data codeword table index has a separate index, for example consecutive integers starting from 0. A version of the instant embodiment with two display data codeword tables may use an assignment table as shown in Table 4A. Possible threshold values are divided into subranges and mapping the subranges to the display data codeword table index values, so that threshold values within a subrange are assigned a same display data codeword table index. In the instant version, pixels with threshold values from step 310 of FIG. 3 in the first subrange, between 0 percent and 25 percent, are assigned a display data codeword table index of 0. Pixels with threshold values in the second subrange, greater than 25 percent up to 50 percent, are assigned a display data codeword table index of 1. Pixels with threshold values in the third subrange, greater than 50 percent up to 75 percent, are assigned a display data codeword table index of 0, and so on. Using the example pixel described above with threshold value 796, the threshold value percentage is 796/1024×100=77.7 percent, after rounding off. Using Table 4A, this pixel is in the fourth subrange and is assigned a display data codeword table index of 1. Using the example vertically immediately adjacent pixel described above with threshold value 126, the threshold value percentage is 126/1024×100=12.3 percent, after rounding off. Using Table 4A, this pixel is in the first subrange and is assigned a display data codeword table index of 0. Other assignment processes may be used for versions of the instant embodiment with two display data codewords, in which the threshold values are divided into at least four approximately equal subranges, and the display data codeword table indices are alternated between adjacent subranges.

A version of the instant embodiment with three display data codeword tables may use an assignment table as shown in Table 4B. Other assignment processes may be used for versions of the instant embodiment with three display data codewords, in which the threshold values are divided into at least six approximately equal subranges, and so that identical display data codeword table indices are not assigned to adjacent subranges.

A version of the instant embodiment with four display data codeword tables may use an assignment table as shown in Table 4C. An alternate version of the instant embodiment with four display data codeword tables may use an assignment table as shown in Table 4D. Other assignment processes may be used for versions of the instant embodiment with four display data codewords, in which the threshold values are divided into at least eight approximately equal subranges, and so that identical display data codeword table indices are not assigned to adjacent subranges. In one version of the instant embodiment, the display data codeword table indices are evenly distributed among the threshold value subranges. Other assignment processes may be used for versions of the instant embodiment with two display data codewords, in which the threshold values are divided into at least twice as many approximately equal subranges as there are display data codewords, and so that identical display data codeword table indices are not assigned to adjacent subranges.

FIG. 5 illustrates an example of a general case of assignments of a display data codeword table index to a pixel. In the case of N display data codewords, the threshold values may be divided into 2N equal subranges. The display data codeword table indices may be assigned in two cycles of ascending order from 0 to N−1, as depicted in the "display data codeword table index" column of FIG. 5.

FIG. 6 illustrates an example of a general case of assignments of a display data codeword table index to a pixel using a look-up table. Values of the threshold array are mapped to values of the display data codeword table indices. In one version of the instant embodiment, the display data codeword table indices may be evenly distributed among the threshold values. In one version, the display data codeword table indices may be listed in a repeating cyclic order.

FIGS. 7A and 7B illustrate examples in Tables 7A-7H of bit time group assignments. Display data bits are assigned time weights; some of the time weights may be substantially equal, forming time groups. Separate time groups have time weights in which a minimum time weight a first time group is greater than a maximum time weight in a second time group. A version of the instant embodiment using six display data bits may use a bit time group assignment table as shown in Table 7A. In this version, display data bits 0 and 1 are assigned equal time weights of 11, and form time group A. Display data bits 2 and 3 are assigned equal time weights of 33 to form time group B, and display data bits 4 and 5 are assigned equal time weights of 83.5 to form time group C. Operating a PWM display using the bit time group assignments of Table 7A allows immediately adjacent pixels to use different display data bits from a time group to display a same intensity, which may reduce PWM temporal contouring artifacts. Details of displaying a given intensity using different display data bits in immediately adjacent pixels will be discussed in reference to FIGS. 7A and 7B below.

It is not necessary to assign all the display data bits to time groups. Another version of the instant embodiment using seven display data bits may use a bit time group assignment table as shown in Table 7B. In this version, display data bit 0, which is the least significant bit (LSB) of the seven display data bits, is assigned a time weight of 10, and is not part of a time group. Display data bits 1, 2 and 3 are assigned equal time weights of 20 to form time group A, and display data bits 4, 5 and 6 are assigned equal time weights of 61.67 to form time group B.

Time groups may contain different numbers of display data bits. A version of the instant embodiment using ten display data bits may use a bit time group assignment table as shown in Table 7C. In this version, display data bits 0 and 1 are assigned equal time weights of 5 to form time group A, and display data bits 2 and 3 are assigned equal time weights of 15 to form time group B. Display data bits 4, 5 and 6 are assigned equal time weights of 30 to form time group C, and display data bits 7, 8 and 9 are assigned equal time weights of 41.67 to form time group D. Thus, time groups A and B include two display data bits each, and time groups C and D include three display data bits each.

An example version of the instant embodiment using eight display data bits may assign the display data bits to four time groups with two display data bits each, as shown in the bit time group assignment scheme of Table 7D. A version of the instant embodiment using fourteen display data bits may assign the display data bits to seven time groups with two display data bits each as shown in the bit time group assignment scheme of Table 7E. A version of the instant embodiment using fifteen display data bits in which a least significant bit is not assigned to a time group may assign the display data bits to seven time groups with two display data bits each as shown in the bit time group assignment scheme of Table 7F. A version of the instant embodiment using sixteen display data bits may assign the display data bits to eight time groups with two display data bits each as shown in the bit time group assignment scheme of Table 7G. An alternate version of the instant embodiment using sixteen display data bits may assign the display data bits to four time groups with four display data bits each as shown in the bit time group assignment scheme of Table 7H.

An example of display data codeword tables for a PWM display using eight display data bits which are assigned using two display data codeword table indices is shown in Table 1 and Table 2. The display data codeword tables of Table 1 and Table 2 may use, for example, the bit time group assignments of Table 7D of FIGS. 7A and 7B. The display data codeword tables of Table 1 and Table 2 accommodate 64 pixel intensity values. In one version of the instant embodiment, the display data codeword tables of Table 1 and Table 2 may be implemented in the PWM display system in look-up tables. In another version of the instant embodiment, the display data codeword tables may be implemented in digital logic such as a combination of NAND and NOR gates.

Each display data codeword includes a single pixel intensity value and the values of the display data bits for all the display data codeword table indices. In one version of the instant invention, a weighted average of values assigned to the display data bits for the first display data codeword table index for a given pixel intensity value is equal to a weighted average of values assigned to the display data bits for every other display data codeword table index. Thus, a same temporal average intensity is displayed for every pixel with the same pixel intensity value.

TABLE 1

| Display data codeword table index = 0 | | | | | | | | | |
|---|---|---|---|---|---|---|---|---|---|
| Codeword number | Pixel intensity value | Display data bit 7 | Display data bit 6 | Display data bit 5 | Display data bit 4 | Display data bit 3 | Display data bit 2 | Display data bit 1 | Display data bit 0 |
| 0 | 4 | 0 | 0 | 0 | 0 | 0 | 0 | 1 | 0 |
| 1 | 8 | 0 | 0 | 0 | 0 | 0 | 0 | 1 | 1 |
| 2 | 12 | 0 | 0 | 0 | 0 | 0 | 1 | 0 | 0 |
| 3 | 16 | 0 | 0 | 0 | 0 | 0 | 1 | 1 | 0 |
| 4 | 20 | 0 | 0 | 0 | 0 | 1 | 0 | 1 | 1 |
| 5 | 24 | 0 | 0 | 0 | 0 | 1 | 1 | 0 | 0 |
| 6 | 28 | 0 | 0 | 0 | 0 | 1 | 1 | 1 | 0 |
| 7 | 32 | 0 | 0 | 0 | 1 | 0 | 0 | 0 | 0 |
| 8 | 36 | 0 | 0 | 0 | 1 | 0 | 0 | 1 | 0 |
| 9 | 40 | 0 | 0 | 0 | 1 | 0 | 0 | 1 | 1 |
| 10 | 44 | 0 | 0 | 0 | 1 | 0 | 1 | 0 | 0 |
| 11 | 48 | 0 | 0 | 0 | 1 | 0 | 1 | 1 | 0 |
| 12 | 52 | 0 | 0 | 0 | 1 | 1 | 0 | 1 | 1 |
| 13 | 56 | 0 | 0 | 0 | 1 | 1 | 1 | 0 | 0 |
| 14 | 60 | 0 | 0 | 0 | 1 | 1 | 1 | 1 | 0 |
| 15 | 64 | 0 | 0 | 1 | 1 | 0 | 0 | 0 | 0 |
| 16 | 68 | 0 | 0 | 1 | 1 | 0 | 0 | 1 | 0 |
| 17 | 72 | 0 | 0 | 1 | 1 | 0 | 0 | 1 | 1 |
| 18 | 76 | 0 | 0 | 1 | 1 | 0 | 1 | 0 | 0 |
| 19 | 80 | 0 | 0 | 1 | 1 | 0 | 1 | 1 | 0 |
| 20 | 84 | 0 | 0 | 1 | 1 | 1 | 0 | 1 | 1 |
| 21 | 88 | 0 | 0 | 1 | 1 | 1 | 1 | 0 | 0 |
| 22 | 92 | 0 | 0 | 1 | 1 | 1 | 1 | 1 | 0 |
| 23 | 95.5 | 0 | 1 | 0 | 0 | 0 | 1 | 1 | 0 |
| 24 | 99.5 | 0 | 1 | 0 | 0 | 1 | 0 | 1 | 1 |
| 25 | 103.5 | 0 | 1 | 0 | 0 | 1 | 1 | 0 | 0 |
| 26 | 107.5 | 0 | 1 | 0 | 0 | 1 | 1 | 1 | 0 |
| 27 | 111.5 | 0 | 1 | 0 | 1 | 0 | 0 | 0 | 0 |
| 28 | 115.5 | 0 | 1 | 0 | 1 | 0 | 0 | 1 | 0 |
| 29 | 119.5 | 0 | 1 | 0 | 1 | 0 | 0 | 1 | 1 |
| 30 | 123.5 | 0 | 1 | 0 | 1 | 0 | 1 | 0 | 0 |
| 31 | 127.5 | 0 | 1 | 0 | 1 | 0 | 1 | 1 | 0 |
| 32 | 131.5 | 0 | 1 | 0 | 1 | 1 | 0 | 1 | 1 |
| 33 | 135.5 | 0 | 1 | 0 | 1 | 1 | 1 | 0 | 0 |
| 34 | 139.5 | 0 | 1 | 0 | 1 | 1 | 1 | 1 | 0 |
| 35 | 143.5 | 0 | 1 | 1 | 1 | 0 | 0 | 0 | 0 |
| 36 | 147.5 | 0 | 1 | 1 | 1 | 0 | 0 | 1 | 0 |
| 37 | 151.5 | 0 | 1 | 1 | 1 | 0 | 0 | 1 | 1 |

TABLE 1-continued

| Display data codeword table index = 0 | | | | | | | | | |
|---|---|---|---|---|---|---|---|---|---|
| Codeword number | Pixel intensity value | Display data bit 7 | Display data bit 6 | Display data bit 5 | Display data bit 4 | Display data bit 3 | Display data bit 2 | Display data bit 1 | Display data bit 0 |
| 38 | 155.5 | 0 | 1 | 1 | 1 | 0 | 1 | 0 | 0 |
| 39 | 159.5 | 0 | 1 | 1 | 1 | 0 | 1 | 1 | 0 |
| 40 | 163.5 | 0 | 1 | 1 | 1 | 1 | 0 | 1 | 1 |
| 41 | 167.5 | 0 | 1 | 1 | 1 | 1 | 1 | 0 | 0 |
| 42 | 171.5 | 0 | 1 | 1 | 1 | 1 | 1 | 1 | 0 |
| 43 | 175 | 1 | 1 | 0 | 0 | 0 | 1 | 1 | 0 |
| 44 | 179 | 1 | 1 | 0 | 0 | 1 | 0 | 1 | 1 |
| 45 | 183 | 1 | 1 | 0 | 0 | 1 | 1 | 0 | 0 |
| 46 | 187 | 1 | 1 | 0 | 0 | 1 | 1 | 1 | 0 |
| 47 | 191 | 1 | 1 | 0 | 1 | 0 | 0 | 0 | 0 |
| 48 | 195 | 1 | 1 | 0 | 1 | 0 | 0 | 1 | 0 |
| 49 | 199 | 1 | 1 | 0 | 1 | 0 | 0 | 1 | 1 |
| 50 | 203 | 1 | 1 | 0 | 1 | 0 | 1 | 0 | 0 |
| 51 | 207 | 1 | 1 | 0 | 1 | 0 | 1 | 1 | 0 |
| 52 | 211 | 1 | 1 | 0 | 1 | 1 | 0 | 1 | 1 |
| 53 | 215 | 1 | 1 | 0 | 1 | 1 | 1 | 0 | 0 |
| 54 | 219 | 1 | 1 | 0 | 1 | 1 | 1 | 1 | 0 |
| 55 | 223 | 1 | 1 | 1 | 1 | 0 | 0 | 0 | 0 |
| 56 | 227 | 1 | 1 | 1 | 1 | 0 | 0 | 1 | 0 |
| 57 | 231 | 1 | 1 | 1 | 1 | 0 | 0 | 1 | 1 |
| 58 | 235 | 1 | 1 | 1 | 1 | 0 | 1 | 0 | 0 |
| 59 | 239 | 1 | 1 | 1 | 1 | 0 | 1 | 1 | 0 |
| 60 | 243 | 1 | 1 | 1 | 1 | 1 | 0 | 1 | 1 |
| 61 | 247 | 1 | 1 | 1 | 1 | 1 | 1 | 0 | 0 |
| 62 | 251 | 1 | 1 | 1 | 1 | 1 | 1 | 1 | 0 |
| 63 | 255 | 1 | 1 | 1 | 1 | 1 | 1 | 1 | 1 |

TABLE 2

| Display data codeword table index = 1 | | | | | | | | | |
|---|---|---|---|---|---|---|---|---|---|
| Codeword number | Pixel intensity value | Display data bit 7 | Display data bit 6 | Display data bit 5 | Display data 'bit 4 | Display data 'bit 3 | Display data bit 2 | Display data bit 1 | Display data bit 0 |
| 0 | 4 | 0 | 0 | 0 | 0 | 0 | 0 | 0 | 1 |
| 1 | 8 | 0 | 0 | 0 | 0 | 0 | 0 | 1 | 1 |
| 2 | 12 | 0 | 0 | 0 | 0 | 1 | 0 | 0 | 0 |
| 3 | 16 | 0 | 0 | 0 | 0 | 1 | 0 | 0 | 1 |
| 4 | 20 | 0 | 0 | 0 | 0 | 0 | 1 | 1 | 1 |
| 5 | 24 | 0 | 0 | 0 | 0 | 1 | 1 | 0 | 0 |
| 6 | 28 | 0 | 0 | 0 | 0 | 1 | 1 | 0 | 1 |
| 7 | 32 | 0 | 0 | 1 | 0 | 0 | 0 | 0 | 0 |
| 8 | 36 | 0 | 0 | 1 | 0 | 0 | 0 | 0 | 1 |
| 9 | 40 | 0 | 0 | 1 | 0 | 0 | 0 | 1 | 1 |
| 10 | 44 | 0 | 0 | 1 | 0 | 1 | 0 | 0 | 0 |
| 11 | 48 | 0 | 0 | 1 | 0 | 1 | 0 | 0 | 1 |
| 12 | 52 | 0 | 0 | 1 | 0 | 0 | 1 | 1 | 1 |
| 13 | 56 | 0 | 0 | 1 | 0 | 1 | 1 | 0 | 0 |
| 14 | 60 | 0 | 0 | 1 | 0 | 1 | 1 | 0 | 1 |
| 15 | 64 | 0 | 0 | 1 | 1 | 0 | 0 | 0 | 0 |
| 16 | 68 | 0 | 0 | 1 | 1 | 0 | 0 | 0 | 1 |
| 17 | 72 | 0 | 0 | 1 | 1 | 0 | 0 | 1 | 1 |
| 18 | 76 | 0 | 0 | 1 | 1 | 1 | 0 | 0 | 0 |
| 19 | 80 | 0 | 0 | 1 | 1 | 1 | 0 | 0 | 1 |
| 20 | 84 | 0 | 0 | 1 | 1 | 0 | 1 | 1 | 1 |
| 21 | 88 | 0 | 0 | 1 | 1 | 1 | 1 | 0 | 0 |
| 22 | 92 | 0 | 0 | 1 | 1 | 1 | 1 | 0 | 1 |
| 23 | 95.5 | 1 | 0 | 0 | 0 | 1 | 0 | 0 | 1 |
| 24 | 99.5 | 1 | 0 | 0 | 0 | 0 | 1 | 1 | 1 |
| 25 | 103.5 | 1 | 0 | 0 | 0 | 1 | 1 | 0 | 0 |
| 26 | 107.5 | 1 | 0 | 0 | 0 | 1 | 1 | 0 | 1 |
| 27 | 111.5 | 1 | 0 | 1 | 0 | 0 | 0 | 0 | 0 |
| 28 | 115.5 | 1 | 0 | 1 | 0 | 0 | 0 | 0 | 1 |
| 29 | 119.5 | 1 | 0 | 1 | 0 | 0 | 0 | 1 | 1 |
| 30 | 123.5 | 1 | 0 | 1 | 0 | 1 | 0 | 0 | 0 |
| 31 | 127.5 | 1 | 0 | 1 | 0 | 1 | 0 | 0 | 1 |
| 32 | 131.5 | 1 | 0 | 1 | 0 | 0 | 1 | 1 | 1 |
| 33 | 135.5 | 1 | 0 | 1 | 0 | 1 | 1 | 0 | 0 |
| 34 | 139.5 | 1 | 0 | 1 | 0 | 1 | 1 | 0 | 1 |
| 35 | 143.5 | 1 | 0 | 1 | 1 | 0 | 0 | 0 | 0 |

TABLE 2-continued

| Display data codeword table index = 1 | | | | | | | | | |
|---|---|---|---|---|---|---|---|---|---|
| Codeword number | Pixel intensity value | Display data bit 7 | Display data bit 6 | Display data bit 5 | Display data 'bit 4 | Display data 'bit 3 | Display data bit 2 | Display data bit 1 | Display data bit 0 |
| 36 | 147.5 | 1 | 0 | 1 | 1 | 0 | 0 | 0 | 1 |
| 37 | 151.5 | 1 | 0 | 1 | 1 | 0 | 0 | 1 | 1 |
| 38 | 155.5 | 1 | 0 | 1 | 1 | 1 | 0 | 0 | 0 |
| 39 | 159.5 | 1 | 0 | 1 | 1 | 1 | 0 | 0 | 1 |
| 40 | 163.5 | 1 | 0 | 1 | 1 | 0 | 1 | 1 | 1 |
| 41 | 167.5 | 1 | 0 | 1 | 1 | 1 | 1 | 0 | 0 |
| 42 | 171.5 | 1 | 0 | 1 | 1 | 1 | 1 | 0 | 1 |
| 43 | 175 | 1 | 1 | 0 | 0 | 1 | 0 | 0 | 1 |
| 44 | 179 | 1 | 1 | 0 | 0 | 0 | 1 | 1 | 1 |
| 45 | 183 | 1 | 1 | 0 | 0 | 1 | 1 | 0 | 0 |
| 46 | 187 | 1 | 1 | 0 | 0 | 1 | 1 | 0 | 1 |
| 47 | 191 | 1 | 1 | 1 | 0 | 0 | 0 | 0 | 0 |
| 48 | 195 | 1 | 1 | 1 | 0 | 0 | 0 | 0 | 1 |
| 49 | 199 | 1 | 1 | 1 | 0 | 0 | 0 | 1 | 1 |
| 50 | 203 | 1 | 1 | 1 | 0 | 1 | 0 | 0 | 0 |
| 51 | 207 | 1 | 1 | 1 | 0 | 1 | 0 | 0 | 1 |
| 52 | 211 | 1 | 1 | 1 | 0 | 0 | 1 | 1 | 1 |
| 53 | 215 | 1 | 1 | 1 | 0 | 1 | 1 | 0 | 0 |
| 54 | 219 | 1 | 1 | 1 | 0 | 1 | 1 | 0 | 1 |
| 55 | 223 | 1 | 1 | 1 | 1 | 0 | 0 | 0 | 0 |
| 56 | 227 | 1 | 1 | 1 | 1 | 0 | 0 | 0 | 1 |
| 57 | 231 | 1 | 1 | 1 | 1 | 0 | 0 | 1 | 1 |
| 58 | 235 | 1 | 1 | 1 | 1 | 1 | 0 | 0 | 0 |
| 59 | 239 | 1 | 1 | 1 | 1 | 1 | 0 | 0 | 1 |
| 60 | 243 | 1 | 1 | 1 | 1 | 0 | 1 | 1 | 1 |
| 61 | 247 | 1 | 1 | 1 | 1 | 1 | 1 | 0 | 0 |
| 62 | 251 | 1 | 1 | 1 | 1 | 1 | 1 | 0 | 1 |
| 63 | 255 | 1 | 1 | 1 | 1 | 1 | 1 | 1 | 1 |

Figure 8:
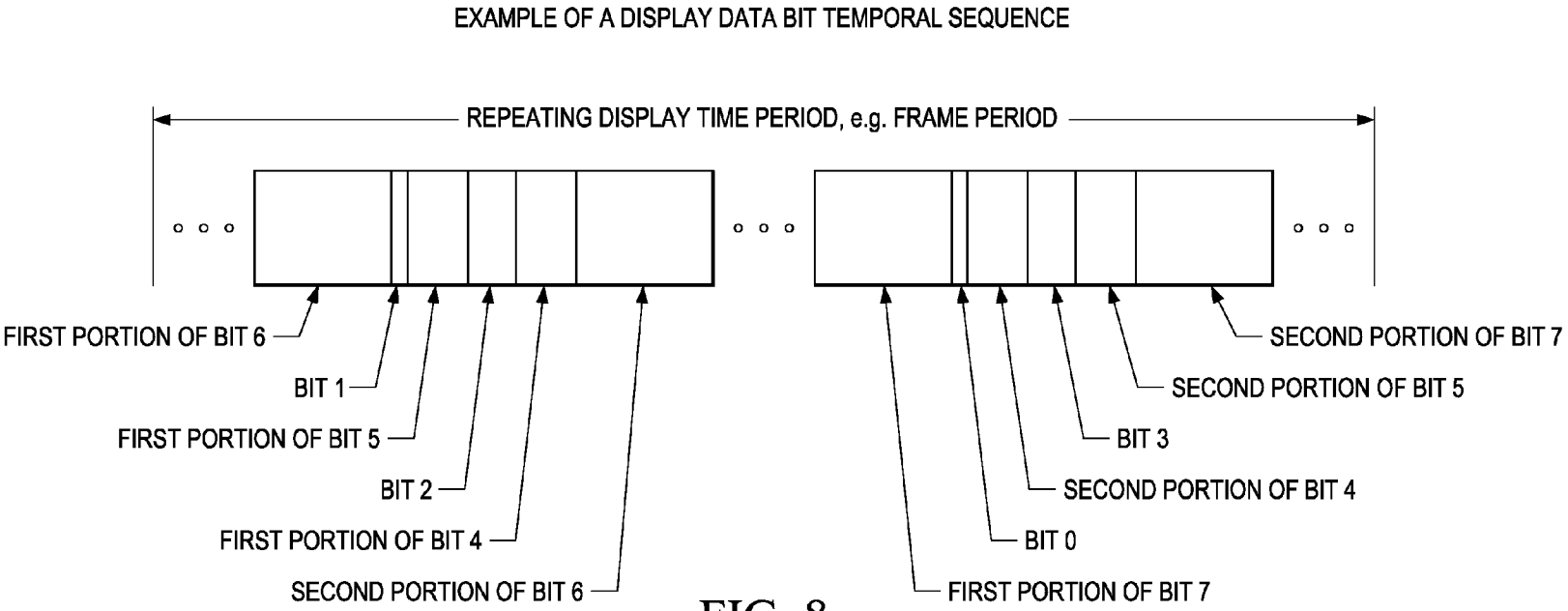
FIG. 8 depicts an example time sequence for display data bits of a PWM display system using eight display data bits.

FIG. 8 depicts an example time sequence for display data bits of a PWM display system using eight display data bits, in which the data bits are assigned time weights according to Table 7D of FIGS. 7A and 7B. In one version of the instant embodiment, the time sequence for the display data bits may be separated into two subsequences, as shown in FIG. 8. In other versions of the instant embodiment, all the display data bits may be used in a single time sequence. In one version of the instant embodiment, display time periods for higher order bits, such as bits 4 through 7, may be separated into portions, as shown in FIG. 8. Time slots for all the display data bits are present within a repeating display time period, such as a frame period. The time weights may be defined so as to provide a desired integrated intensity from the pixel. For example, the time weights may take into account a switching time delay of the pixel.

Figure 9:
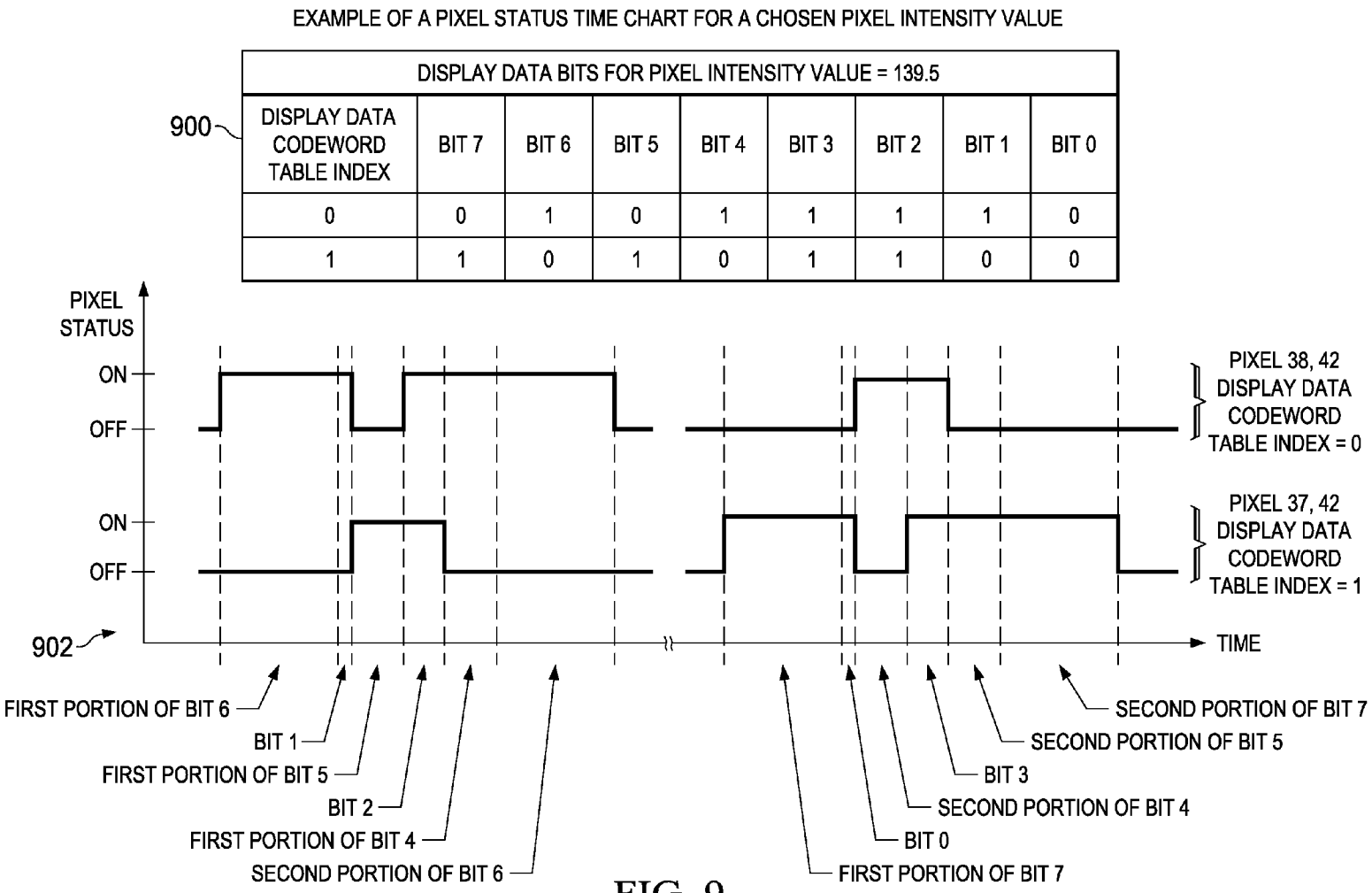
FIG. 9 depicts pixel status (on or off) for a pair of immediately adjacent pixels.

FIG. 9 depicts pixel status (on or off) for a pair of immediately adjacent pixels which are displaying a pixel intensity value of 139.5 using the threshold array of FIGS. 2A and 2B, the display data codeword table assignment scheme of Table 4A of FIG. 4, the example time sequence of FIG. 8 and the display data codeword tables of Table 1 and Table 2. In the instant version depicted in FIG. 9, the display data bits for the pixel intensity value of 139.5 are shown in the summary table 900. A pixel status time chart 902 depicts the status of a first pixel with a row number of 37 and a column number of 42, and a second, vertically immediately adjacent pixel with a row number of 38 and a column number of 42, as described in reference to FIG. 3. As shown in the pixel status time chart 902, the first pixel and the second pixel are not simultaneously on or simultaneously off, which may reduce PWM temporal contouring artifacts. Displaying other pixel intensity values may result in the first pixel and the second pixel being simultaneously on or simultaneously off for a greater or lesser portion of the time sequence.

It will be recognized that a PWM display system may use more display data codeword tables than a maximum number of display data bits in a largest time group. Furthermore, one or more display data codeword tables may include display data codewords in which a weighted average of values assigned to the display data bits for a given pixel intensity value is not equal to a weighted average of values assigned to the display data bits for other display data codeword table index for the same pixel intensity value.

A process of operating a pulse width modulated (PWM) display system is thus described which includes: assigning a first time weight to a first display data bit of the PWM display system; assigning a second time weight to a second display data bit of the PWM display system, the second time weight having a weight value between 90 percent and 110 percent of the first time weight; determining a first threshold value for a first pixel of the PWM display system, the first threshold value being provided from a high spatial frequency threshold array; determining a second threshold value for a second pixel of the PWM display system, the second pixel being immediately adjacent to the first pixel, the second threshold value being provided from the threshold array; assigning a first display data codeword table index to the first pixel, the first display data codeword table index being a function of the first threshold value; assigning a second display data codeword table index to the second pixel, the second display data codeword table index having a different value from the first display data codeword table index, the second display data codeword table index being a function of the second threshold value; assigning a pixel intensity value to be displayed by the first pixel; assigning the pixel intensity value to be displayed by the second pixel; defining a first display data codeword for the first pixel as a function of the first display data codeword table index and the pixel intensity value, and defining a second display data codeword for the second pixel as a function of the second display data codeword table index and the pixel intensity value, so that: a value of the first display data bit defined for the first pixel is different from a value of the second display data bit defined for the first pixel, the value of the first display data bit defined for the first pixel is different from a value of the first display data bit defined for the second pixel, and the value of the second display data bit defined for the first pixel is different from a value of the second display data bit defined for the second pixel.

The described method may further include steps of: assigning a third time weight to a third display data bit of the PWM display system, so that the third time weight is greater than the first time weight and greater than the second time weight; assigning a fourth time weight to a fourth display data bit of the PWM display system, the fourth time weight having a weight value between 90 percent and 110 percent of the third time weight, so that the fourth time weight is greater than the first time weight and greater than the second time weight; so that the step of defining the display data codeword and the step of defining the display data codeword are performed so that: a value of the third display data bit defined for the first pixel is different from a value of the fourth display data bit defined for the first pixel, the value of the third display data bit defined for the first pixel is different from a value of the third display data bit defined for the second pixel, and the value of the fourth display data bit defined for the first pixel is different from a value of the fourth display data bit defined for the second pixel.

The described process may further include steps: assigning a third time weight to a third display data bit of the PWM display system, the third time weight having a weight value between 90 percent and 110 percent of the first time weight; determining a third threshold value for a third pixel of the PWM display system, the third pixel being immediately adjacent to the first pixel, the third threshold value being provided from the threshold array; assigning a third display data codeword table index to the third pixel, the third display data codeword table index having a different value from the first display data codeword table index and from the second display data codeword table index, the third display data codeword table index being a function of the third threshold value; assigning the pixel intensity value to be displayed by the third pixel; and defining a third display data codeword for the third pixel as a function of the third display data codeword table index and the pixel intensity value. The step of defining the third display data codeword for the third pixel may be performed so that: an average of the value of the first display data bit for the first pixel, the value of the second display data bit for the first pixel and a value of the third display data bit for the first pixel is equal to an average of the value of the first display data bit for the second pixel, the value of the second display data bit for the second pixel and a value of the third display data bit for the second pixel; and the average of the value of the first display data bit for the first pixel, the value of the second display data bit for the first pixel and a value of the third display data bit for the first pixel is equal to an average of the value of the first display data bit for the third pixel, the value of the second display data bit for the third pixel and a value of the third display data bit for the third pixel. The process may further include steps: assigning a fourth time weight to a fourth display data bit of the PWM display system, so that the fourth time weight is greater than the first time weight and greater than the second time weight; assigning a fifth time weight to a fifth display data bit of the PWM display system, the fifth time weight having a weight value between 90 percent and 110 percent of the fourth time weight, so that the fifth time weight is greater than the first time weight and greater than the second time weight; so that the step of defining a first display data codeword and the step of defining a second display data codeword are performed so that: a value of the fourth display data bit defined for the first pixel is different from a value of the fifth display data bit defined for the first pixel, the value of the fourth display data bit defined for the first pixel is different from a value of the fourth display data bit defined for the second pixel, and the value of the fifth display data bit defined for the first pixel is different from a value of the fifth display data bit defined for the second pixel.

Every display data bit may be assigned a time weight which is between 90 percent and 110 percent of a time weight assigned to at least one other display data bit. The step of assigning the first display data codeword table index to the first pixel may include steps: dividing possible threshold values from the threshold array into subranges; mapping the subranges to values of the display data codeword table index; determining which of the subranges includes the first threshold value assigned to the first pixel; determining which the value of the display data codeword table index is mapped to by the subrange; and assigning the value of the display data codeword table index to the first pixel. The step of assigning the first display data codeword table index to the first pixel may be implemented using a look-up table. The display data codeword tables may be implemented as look-up tables or in logic gates.

The process may further include the step of adjusting the threshold array prior to the steps of determining the first threshold value and determining the second threshold value, the step of adjusting the threshold array including an operation selected from the group consisting of: rotating the threshold array, reflecting the threshold array, spatially inverting the threshold array, uniformly incrementing values in the threshold array, uniformly decrementing values in the threshold array, and bit-wise inverting the threshold array. A number of the display data codeword tables may be more than a maximum number of the display data bits assigned to substantially equal time weights.

The PWM display system may include at least fourteen display data bits, further including steps: assigning a third time weight to a third display data bit of the PWM display system, so that the third time weight is greater than the first time weight and greater than the second time weight; assigning a fourth time weight to a fourth display data bit of the PWM display system, the fourth time weight having a weight value between 90 percent and 110 percent of the third time weight, so that the fourth time weight is greater than the first time weight and greater than the second time weight; assigning a fifth time weight to a fifth display data bit of the PWM display system, so that the fifth time weight is greater than the third time weight and greater than the fourth time weight; assigning a sixth time weight to a sixth display data bit of the PWM display system, the sixth time weight having a weight value between 90 percent and 110 percent of the fifth time weight, so that the sixth time weight is greater than the third time weight and greater than the fourth time weight; assigning a seventh time weight to a seventh display data bit of the PWM display system, so that the seventh time weight is greater than the fifth time weight and greater than the sixth time weight; assigning an eighth time weight to an eighth display data bit of the PWM display system, the eighth time weight having a weight value between 90 percent and 110 percent of the seventh time weight, so that the eighth time weight is greater than the fifth time weight and greater than the sixth time weight; assigning a ninth time weight to a ninth display data bit of the PWM display system, so that the ninth time weight is greater than the seventh time weight and greater than the eighth time weight; assigning a tenth time weight to a tenth display data bit of the PWM display system, the tenth time weight having a weight value between 90 percent and 110 percent of the ninth time weight, so that the tenth time weight is greater than the seventh time weight and greater than the eighth time weight; assigning an eleventh time weight to an eleventh display data bit of the PWM display system, so that the eleventh time weight is greater than the ninth time weight and greater than the tenth time weight; assigning a twelfth time weight to a twelfth display data bit of the PWM display system, the twelfth time weight having a weight value between 90 percent and 110 percent of the eleventh time weight, so that the twelfth time weight is greater than the ninth time weight and greater than the tenth time weight; assigning a thirteenth time weight to a thirteenth display data bit of the PWM display system, so that the thirteenth time weight is greater than the eleventh time weight and greater than the twelfth time weight; and assigning a fourteenth time weight to a fourteenth display data bit of the PWM display system, the fourteenth time weight having a weight value between 90 percent and 110 percent of the thirteenth time weight, so that the fourteenth time weight is greater than the eleventh time weight and greater than the twelfth time weight.

The PWM display system may include at least fifteen display data bits, further including steps: assigning a third time weight to a third display data bit of the PWM display system, so that the third time weight is greater than the first time weight and greater than the second time weight; assigning a fourth time weight to a fourth display data bit of the PWM display system, the fourth time weight having a weight value between 90 percent and 110 percent of the third time weight, so that the fourth time weight is greater than the first time weight and greater than the second time weight; assigning a fifth time weight to a fifth display data bit of the PWM display system, so that the fifth time weight is greater than the third time weight and greater than the fourth time weight; assigning a sixth time weight to a sixth display data bit of the PWM display system, the sixth time weight having a weight value between 90 percent and 110 percent of the fifth time weight, so that the sixth time weight is greater than the third time weight and greater than the fourth time weight; assigning a seventh time weight to a seventh display data bit of the PWM display system, so that the seventh time weight is greater than the fifth time weight and greater than the sixth time weight; assigning an eighth time weight to an eighth display data bit of the PWM display system, the eighth time weight having a weight value between 90 percent and 110 percent of the seventh time weight, so that the eighth time weight is greater than the fifth time weight and greater than the sixth time weight; assigning a ninth time weight to a ninth display data bit of the PWM display system, so that the ninth time weight is greater than the seventh time weight and greater than the eighth time weight; assigning a tenth time weight to a tenth display data bit of the PWM display system, the tenth time weight having a weight value between 90 percent and 110 percent of the ninth time weight, so that the tenth time weight is greater than the seventh time weight and greater than the eighth time weight; assigning an eleventh time weight to an eleventh display data bit of the PWM display system, so that the eleventh time weight is greater than the ninth time weight and greater than the tenth time weight; assigning a twelfth time weight to a twelfth display data bit of the PWM display system, the twelfth time weight having a weight value between 90 percent and 110 percent of the eleventh time weight, so that the twelfth time weight is greater than the ninth time weight and greater than the tenth time weight; assigning a thirteenth time weight to a thirteenth display data bit of the PWM display system, so that the thirteenth time weight is greater than the eleventh time weight and greater than the twelfth time weight; assigning a fourteenth time weight to a fourteenth display data bit of the PWM display system, the fourteenth time weight having a weight value between 90 percent and 110 percent of the thirteenth time weight, so that the fourteenth time weight is greater than the eleventh time weight and greater than the twelfth time weight; and assigning a fifteenth time weight to a fifteenth display data bit of the PWM display system, so that the fifteenth time weight is less than the first time weight and less than the second time weight.

A process of operating a PWM display system may include: assigning a first time weight to a first display data bit of the PWM display system; assigning a second time weight to a second display data bit of the PWM display system, the second time weight having a weight value between 90 percent and 110 percent of the first time weight; assigning a first display data codeword table index to the first pixel; assigning a second display data codeword table index to the second pixel, the second display data codeword table index having a different value from the first display data codeword table index; assigning a pixel intensity value to be displayed by the first pixel; assigning the pixel intensity value to be displayed by the second pixel; defining a first display data codeword for the first pixel as a function of the first display data codeword table index and the pixel intensity value, and defining a second display data codeword for the second pixel as a function of the second display data codeword table index and the pixel intensity value, so that: a value of the first display data bit defined for the first pixel is different from a value of the second display data bit defined for the first pixel, the value of the first display data bit defined for the first pixel is different from a value of the first display data bit defined for the second pixel, and the value of the second display data bit defined for the first pixel is different from a value of the second display data bit defined for the second pixel.

Those skilled in the art to which the invention relates will appreciate that modifications may be made to the described embodiments and other embodiments realized within the scope of the claimed invention.

What is claimed is:

1. A process of operating a pulse width modulated (PWM) display system, comprising:

assigning a first time weight to a first display data bit of the PWM display system;

assigning a second time weight to a second display data bit of the PWM display system, the second time weight having a weight value between 90 percent and 110 percent of the first time weight;

determining a first threshold value for a first pixel of the PWM display system, the first threshold value being provided from a high spatial frequency threshold array;

determining a second threshold value for a second pixel of the PWM display system, the second pixel being immediately adjacent to the first pixel, the second threshold value being provided from the threshold array;

assigning a first display data codeword table index to the first pixel, the first display data codeword table index being a function of the first threshold value;

assigning a second display data codeword table index to the second pixel, the second display data codeword table index having a different value from the first display data codeword table index, the second display data codeword table index being a function of the second threshold value;

assigning a pixel intensity value to be displayed by the first pixel;

assigning the pixel intensity value to be displayed by the second pixel;

defining a first display data codeword for the first pixel as a function of the first display data codeword table index and the pixel intensity value, and defining a second display data codeword for the second pixel as a function of the second display data codeword table index and the pixel intensity value, so that:

a value of the first display data bit defined for the first pixel is different from a value of the second display data bit defined for the first pixel;

the value of the first display data bit defined for the first pixel is different from a value of the first display data bit defined for the second pixel; and the value of the second display data bit defined for the first pixel is different from a value of the second display data bit defined for the second pixel.

2. The process of claim 1, further including:

assigning a third time weight to a third display data bit of the PWM display system, so that the third time weight is greater than the first time weight and greater than the second time weight;

assigning a fourth time weight to a fourth display data bit of the PWM display system, the fourth time weight having a weight value between 90 percent and 110 percent of the third time weight, so that the fourth time weight is greater than the first time weight and greater than the second time weight;

so that the step of defining the display data codeword and the step of defining the display data codeword are performed so that:

a value of the third display data bit defined for the first pixel is different from a value of the fourth display data bit defined for the first pixel;

the value of the third display data bit defined for the first pixel is different from a value of the third display data bit defined for the second pixel; and the value of the fourth display data bit defined for the first pixel is different from a value of the fourth display data bit defined for the second pixel.

3. The process of claim 1, further including:

assigning a third time weight to a third display data bit of the PWM display system, the third time weight having a weight value between 90 percent and 110 percent of the first time weight;

determining a third threshold value for a third pixel of the PWM display system, the third pixel being immediately adjacent to the first pixel, the third threshold value being provided from the threshold array;

assigning a third display data codeword table index to the third pixel, the third display data codeword table index having a different value from the first display data codeword table index and from the second display data codeword table index, the third display data codeword table index being a function of the third threshold value;

assigning the pixel intensity value to be displayed by the third pixel; and defining a third display data codeword for the third pixel as a function of the third display data codeword table index and the pixel intensity value.

4. The process of claim 3, wherein the step of defining the third display data codeword for the third pixel is performed so that:

an average of the value of the first display data bit for the first pixel, the value of the second display data bit for the first pixel and a value of the third display data bit for the first pixel is equal to an average of the value of the first display data bit for the second pixel, the value of the second display data bit for the second pixel and a value of the third display data bit for the second pixel; and the average of the value of the first display data bit for the first pixel, the value of the second display data bit for the first pixel and a value of the third display data bit for the first pixel is equal to an average of the value of the first display data bit for the third pixel, the value of the second display data bit for the third pixel and a value of the third display data bit for the third pixel.

5. The process of claim 3, further including:

assigning a fourth time weight to a fourth display data bit of the PWM display system, so that the fourth time weight is greater than the first time weight and greater than the second time weight;

assigning a fifth time weight to a fifth display data bit of the PWM display system, the fifth time weight having a weight value between 90 percent and 110 percent of the fourth time weight, so that the fifth time weight is greater than the first time weight and greater than the second time weight;

so that the step of defining a first display data codeword and the step of defining a second display data codeword are performed so that:

a value of the fourth display data bit defined for the first pixel is different from a value of the fifth display data bit defined for the first pixel;

the value of the fourth display data bit defined for the first pixel is different from a value of the fourth display data bit defined for the second pixel; and the value of the fifth display data bit defined for the first pixel is different from a value of the fifth display data bit defined for the second pixel.

6. The process of claim 1, wherein every display data bit is assigned a time weight which is between 90 percent and 110 percent of a time weight assigned to at least one other display data bit.

7. The process of claim 1, wherein the step of assigning the first display data codeword table index to the first pixel includes steps:

dividing possible threshold values from the threshold array into subranges;

mapping the subranges to values of the display data codeword table index;

determining which of the subranges includes the first threshold value assigned to the first pixel;

determining which the value of the display data codeword table index is mapped to by the subrange; and assigning the value of the display data codeword table index to the first pixel.

8. The process of claim 1, wherein the step of assigning the first display data codeword table index to the first pixel is implemented using a look-up table.

9. The process of claim 1, wherein the display data codeword tables are implemented as look-up tables.

10. The process of claim 1, wherein the display data codeword tables are implemented in logic gates.

11. The process of claim 1, further including the step of adjusting the threshold array prior to the steps of determining the first threshold value and determining the second threshold value, the step of adjusting the threshold array including an operation selected from the group consisting of: rotating the threshold array, reflecting the threshold array, spatially inverting the threshold array, uniformly incrementing values in the threshold array, uniformly decrementing values in the threshold array, and bit-wise inverting the threshold array.

12. The process of claim 1, wherein a number of the display data codeword tables is more than a maximum number of the display data bits assigned to substantially equal time weights.

13. The process of claim 1, wherein the PWM display system includes at least fourteen display data bits, further including:

assigning a third time weight to a third display data bit of the PWM display system, so that the third time weight is greater than the first time weight and greater than the second time weight;

assigning a fourth time weight to a fourth display data bit of the PWM display system, the fourth time weight having a weight value between 90 percent and 110 percent of the third time weight, so that the fourth time weight is greater than the first time weight and greater than the second time weight;

assigning a fifth time weight to a fifth display data bit of the PWM display system, so that the fifth time weight is greater than the third time weight and greater than the fourth time weight;

assigning a sixth time weight to a sixth display data bit of the PWM display system, the sixth time weight having a weight value between 90 percent and 110 percent of the fifth time weight, so that the sixth time weight is greater than the third time weight and greater than the fourth time weight;

assigning a seventh time weight to a seventh display data bit of the PWM display system, so that the seventh time weight is greater than the fifth time weight and greater than the sixth time weight;

assigning an eighth time weight to an eighth display data bit of the PWM display system, the eighth time weight having a weight value between 90 percent and 110 percent of the seventh time weight, so that the eighth time weight is greater than the fifth time weight and greater than the sixth time weight;

assigning a ninth time weight to a ninth display data bit of the PWM display system, so that the ninth time weight is greater than the seventh time weight and greater than the eighth time weight;

assigning a tenth time weight to a tenth display data bit of the PWM display system, the tenth time weight having a weight value between 90 percent and 110 percent of the ninth time weight, so that the tenth time weight is greater than the seventh time weight and greater than the eighth time weight;

assigning an eleventh time weight to an eleventh display data bit of the PWM display system, so that the eleventh time weight is greater than the ninth time weight and greater than the tenth time weight;

assigning a twelfth time weight to a twelfth display data bit of the PWM display system, the twelfth time weight having a weight value between 90 percent and 110 percent of the eleventh time weight, so that the twelfth time weight is greater than the ninth time weight and greater than the tenth time weight;

assigning a thirteenth time weight to a thirteenth display data bit of the PWM display system, so that the thirteenth time weight is greater than the eleventh time weight and greater than the twelfth time weight; and assigning a fourteenth time weight to a fourteenth display data bit of the PWM display system, the fourteenth time weight having a weight value between 90 percent and 110 percent of the thirteenth time weight, so that the fourteenth time weight is greater than the eleventh time weight and greater than the twelfth time weight.

14. The process of claim 1, wherein the PWM display system includes at least fifteen display data bits, further including:

assigning a third time weight to a third display data bit of the PWM display system, so that the third time weight is greater than the first time weight and greater than the second time weight;

assigning a fourth time weight to a fourth display data bit of the PWM display system, the fourth time weight having a weight value between 90 percent and 110 percent of the third time weight, so that the fourth time weight is greater than the first time weight and greater than the second time weight;

assigning a fifth time weight to a fifth display data bit of the PWM display system, so that the fifth time weight is greater than the third time weight and greater than the fourth time weight;

assigning a sixth time weight to a sixth display data bit of the PWM display system, the sixth time weight having a weight value between 90 percent and 110 percent of the fifth time weight, so that the sixth time weight is greater than the third time weight and greater than the fourth time weight;

assigning a seventh time weight to a seventh display data bit of the PWM display system, so that the seventh time weight is greater than the fifth time weight and greater than the sixth time weight;

assigning an eighth time weight to an eighth display data bit of the PWM display system, the eighth time weight having a weight value between 90 percent and 110 percent of the seventh time weight, so that the eighth time weight is greater than the fifth time weight and greater than the sixth time weight;

assigning a ninth time weight to a ninth display data bit of the PWM display system, so that the ninth time weight is greater than the seventh time weight and greater than the eighth time weight;

assigning a tenth time weight to a tenth display data bit of the PWM display system, the tenth time weight having a weight value between 90 percent and 110 percent of the ninth time weight, so that the tenth time weight is greater than the seventh time weight and greater than the eighth time weight;

assigning an eleventh time weight to an eleventh display data bit of the PWM display system, so that the eleventh time weight is greater than the ninth time weight and greater than the tenth time weight;

assigning a twelfth time weight to a twelfth display data bit of the PWM display system, the twelfth time weight having a weight value between 90 percent and 110 percent of the eleventh time weight, so that the twelfth time weight is greater than the ninth time weight and greater than the tenth time weight;

assigning a thirteenth time weight to a thirteenth display data bit of the PWM display system, so that the thirteenth time weight is greater than the eleventh time weight and greater than the twelfth time weight;

assigning a fourteenth time weight to a fourteenth display data bit of the PWM display system, the fourteenth time weight having a weight value between 90 percent and 110 percent of the thirteenth time weight, so that the fourteenth time weight is greater than the eleventh time weight and greater than the twelfth time weight; and assigning a fifteenth time weight to a fifteenth display data bit of the PWM display system, so that the fifteenth time weight is less than the first time weight and less than the second time weight.

15. The process of claim 1, wherein the PWM display system includes at least sixteen display data bits, further including:

assigning a third time weight to a third display data bit of the PWM display system, so that the third time weight is greater than the first time weight and greater than the second time weight;

assigning a fourth time weight to a fourth display data bit of the PWM display system, the fourth time weight having a weight value between 90 percent and 110 percent of the third time weight, so that the fourth time weight is greater than the first time weight and greater than the second time weight;

assigning a fifth time weight to a fifth display data bit of the PWM display system, so that the fifth time weight is greater than the third time weight and greater than the fourth time weight;

assigning a sixth time weight to a sixth display data bit of the PWM display system, the sixth time weight having a weight value between 90 percent and 110 percent of the fifth time weight, so that the sixth time weight is greater than the third time weight and greater than the fourth time weight;

assigning a seventh time weight to a seventh display data bit of the PWM display system, so that the seventh time weight is greater than the fifth time weight and greater than the sixth time weight;

assigning an eighth time weight to an eighth display data bit of the PWM display system, the eighth time weight having a weight value between 90 percent and 110 percent of the seventh time weight, so that the eighth time weight is greater than the fifth time weight and greater than the sixth time weight;

assigning a ninth time weight to a ninth display data bit of the PWM display system, so that the ninth time weight is greater than the seventh time weight and greater than the eighth time weight;

assigning a tenth time weight to a tenth display data bit of the PWM display system, the tenth time weight having a weight value between 90 percent and 110 percent of the ninth time weight, so that the tenth time weight is greater than the seventh time weight and greater than the eighth time weight;

assigning an eleventh time weight to an eleventh display data bit of the PWM display system, so that the eleventh time weight is greater than the ninth time weight and greater than the tenth time weight;

assigning a twelfth time weight to a twelfth display data bit of the PWM display system, the twelfth time weight having a weight value between 90 percent and 110 percent of the eleventh time weight, so that the twelfth time weight is greater than the ninth time weight and greater than the tenth time weight;

assigning a thirteenth time weight to a thirteenth display data bit of the PWM display system, so that the thirteenth time weight is greater than the eleventh time weight and greater than the twelfth time weight;

assigning a fourteenth time weight to a fourteenth display data bit of the PWM display system, the fourteenth time weight having a weight value between 90 percent and 110 percent of the thirteenth time weight, so that the fourteenth time weight is greater than the eleventh time weight and greater than the twelfth time weight;

assigning a fifteenth time weight to a fifteenth display data bit of the PWM display system, so that the fifteenth time weight is greater than the thirteenth time weight and greater than the fourteenth time weight; and assigning a sixteenth time weight to a sixteenth display data bit of the PWM display system, the sixteenth time weight having a weight value between 90 percent and 110 percent of the fifteenth time weight, so that the sixteenth time weight is greater than the thirteenth time weight and greater than the fourteenth time weight.

16. The process of claim 1, wherein the PWM display system includes at least sixteen display data bits, further including:

assigning a third time weight to a third display data bit of the PWM display system, the third time weight having a weight value between 90 percent and 110 percent of the first time weight;

assigning a fourth time weight to a fourth display data bit of the PWM display system, the fourth time weight having a weight value between 90 percent and 110 percent of the first time weight;

assigning a fifth time weight to a fifth display data bit of the PWM display system, so that the fifth time weight is greater than the first time weight, greater than the second time weight, greater than the third time weight, and greater than the fourth time weight;

assigning a sixth time weight to a sixth display data bit of the PWM display system, the sixth time weight having a weight value between 90 percent and 110 percent of the fifth time weight, so that the sixth time weight is greater than the first time weight, greater than the second time weight, greater than the third time weight, and greater than the fourth time weight;

assigning a seventh time weight to a seventh display data bit of the PWM display system, the seventh time weight having a weight value between 90 percent and 110 percent of the fifth time weight, so that the seventh time weight is greater than the first time weight, greater than the second time weight, greater than the third time weight, and greater than the fourth time weight;

assigning an eighth time weight to an eighth display data bit of the PWM display system, the eighth time weight having a weight value between 90 percent and 110 percent of the fifth time weight, so that the eighth time weight is greater than the first time weight, greater than the second time weight, greater than the third time weight, and greater than the fourth time weight;

assigning a ninth time weight to a ninth display data bit of the PWM display system, so that the ninth time weight is greater than the fifth time weight, greater than the sixth time weight, greater than the seventh time weight, and greater than the eighth time weight;

assigning a tenth time weight to a tenth display data bit of the PWM display system, the tenth time weight having a weight value between 90 percent and 110 percent of the ninth time weight, so that the tenth time weight is greater than the fifth time weight, greater than the sixth time weight, greater than the seventh time weight, and greater than the eighth time weight;

assigning an eleventh time weight to an eleventh display data bit of the PWM display system, the eleventh time weight having a weight value between 90 percent and 110 percent of the ninth time weight, so that the eleventh time weight is greater than the fifth time weight, greater than the sixth time weight, greater than the seventh time weight, and greater than the eighth time weight;

assigning a twelfth time weight to a twelfth display data bit of the PWM display system, the twelfth time weight having a weight value between 90 percent and 110 percent of the ninth time weight, so that the twelfth time weight is greater than the fifth time weight, greater than the sixth time weight, greater than the seventh time weight, and greater than the eighth time weight;

assigning a thirteenth time weight to a thirteenth display data bit of the PWM display system, so that the thirteenth time weight is greater than the ninth time weight, greater than the tenth time weight, greater than the eleventh time weight and greater than the twelfth time weight;

assigning a fourteenth time weight to a fourteenth display data bit of the PWM display system, the fourteenth time weight having a weight value between 90 percent and 110 percent of the thirteenth time weight, so that the fourteenth time weight is greater than the ninth time weight, greater than the tenth time weight, greater than the eleventh time weight and greater than the twelfth time weight;

assigning a fifteenth time weight to a fifteenth display data bit of the PWM display system, the fifteenth time weight having a weight value between 90 percent and 110 percent of the thirteenth time weight, so that the fifteenth time weight is greater than the ninth time weight, greater than the tenth time weight, greater than the eleventh time weight and greater than the twelfth time weight; and assigning a sixteenth time weight to a sixteenth display data bit of the PWM display system, the sixteenth time weight having a weight value between 90 percent and 110 percent of the thirteenth time weight, so that the sixteenth time weight is greater than the ninth time weight, greater than the tenth time weight, greater than the eleventh time weight and greater than the twelfth time weight.

17. A process of operating a PWM display system, comprising:

assigning a first time weight to a first display data bit of the PWM display system;

assigning a second time weight to a second display data bit of the PWM display system, the second time weight having a weight value between 90 percent and 110 percent of the first time weight;

assigning a first display data codeword table index to the first pixel;

assigning a second display data codeword table index to the second pixel, the second display data codeword table index having a different value from the first display data codeword table index;

assigning a pixel intensity value to be displayed by the first pixel;

assigning the pixel intensity value to be displayed by the second pixel;

defining a first display data codeword for the first pixel as a function of the first display data codeword table index and the pixel intensity value, and defining a second display data codeword for the second pixel as a function of the second display data codeword table index and the pixel intensity value, so that:

a value of the first display data bit defined for the first pixel is different from a value of the second display data bit defined for the first pixel;

the value of the first display data bit defined for the first pixel is different from a value of the first display data bit defined for the second pixel; and the value of the second display data bit defined for the first pixel is different from a value of the second display data bit defined for the second pixel.

* * * * *